US009257240B2

(12) United States Patent
Park et al.

(10) Patent No.: US 9,257,240 B2
(45) Date of Patent: Feb. 9, 2016

(54) KEY ASSEMBLY AND ELECTRONIC DEVICE HAVING THE SAME

(71) Applicant: Samsung Electronics Co., Ltd., Gyeonggi-do (KR)

(72) Inventors: Jeong-Seok Park, Gyeonggi-do (KR); Joon-Seo Park, Gyeonggi-do (KR); Kwang-Su Seo, Gyeonggi-do (KR); Yong-Woo Jeon, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 227 days.

(21) Appl. No.: 13/927,369

(22) Filed: Jun. 26, 2013

(65) Prior Publication Data

US 2013/0341172 A1 Dec. 26, 2013

(30) Foreign Application Priority Data

Jun. 26, 2012 (CN) ..... 2012 2 0303763 U
May 28, 2013 (KR) ..... 10-2013-0060224

(51) Int. Cl.

| | |
|---|---|
| ***H01H 13/14*** | (2006.01) |
| ***H01H 13/85*** | (2006.01) |
| ***H01H 13/12*** | (2006.01) |
| ***H01H 1/12*** | (2006.01) |

(52) U.S. Cl.

CPC ..... *H01H 1/12* (2013.01); *H01H 13/85* (2013.01); *H01H 2221/044* (2013.01); *H01H 2221/062* (2013.01); *H01H 2221/074* (2013.01); *H01H 2225/028* (2013.01); *H01H 2235/016* (2013.01)

(58) Field of Classification Search

CPC ..... H01H 13/14; H01H 3/12; H01H 13/85; H01H 2221/044
USPC ..... 200/512, 341, 343, 521; 400/490
See application file for complete search history.

(56) References Cited

U.S. PATENT DOCUMENTS

| | | | | |
|---|---|---|---|---|
| 4,366,355 | A * | 12/1982 | Oelsch | 200/517 |
| 2006/0113176 | A1 * | 6/2006 | Shimizu et al. | 200/343 |

FOREIGN PATENT DOCUMENTS

| | | | |
|---|---|---|---|
| EP | 1881515 | A1 | 1/2008 |
| EP | 2402968 | A1 | 1/2012 |
| GB | 2039417 | A | 8/1980 |
| KR | 10-2004-0009948 | A | 1/2004 |
| KR | 10-2004-0079157 | A | 9/2004 |
| KR | 10-2006-0004515 | A | 1/2006 |
| KR | 10-2006-0035181 | A | 4/2006 |
| KR | 10-2006-0043960 | A | 5/2006 |
| KR | 10-2006-0057809 | A | 5/2006 |

* cited by examiner

*Primary Examiner* — Renee Luebke
*Assistant Examiner* — Ahmed Saeed
(74) *Attorney, Agent, or Firm* — Cha & Reiter, LLC.

(57) ABSTRACT

A key assembly which is configured to provide improved click feeling to a user and an electronic device having the same are provided. The key assembly includes a key body of elastic materials and contact projections, each of the contact projections which is protruded and formed from the key body and presses a switch device spaced apart from the key body by a gap providing a certain interval, wherein the key body is installed such that a contact surface of each of the contact projections is in contact with and pushed back by a certain distance by a pre-loading force of the switch device.

16 Claims, 4 Drawing Sheets

KEY ASSEMBLY AND ELECTRONIC DEVICE HAVING THE SAME

CLAIM OF PRIORITY

This application claims the benefit under 35 U.S.C. §119 (a) from a patent applications filed in the Chinese Patent Office on Jun. 26, 2012 and assigned Serial No. 201220303763.X and filed in the Korean Intellectual Property Office on May 28, 2013 and assigned Serial No. 10-2013-0060224, the entire disclosure of which is hereby incorporated by reference in its entirety.

BACKGROUND

1. Field of the Invention

The present disclosure relates to a key assembly. More particularly, the present invention relates to a key assembly which is configured to provide improved click feeling and tactile sensation to a user and an electronic device having the same.

2. Description of the Related Art

In general, each of electronic devices such as a mobile phone, a Moving Picture Experts Group (MPEG) audio layer 3 (MP3) player, a tablet Personal Computer (PC) has a key assembly to enable quick and precise control a user wants.

For example, a side key in the key assembly may be divided into two types according to a type of a switch installed on a Printed Board Assembly (PBA). One of the two types is a Flexible Printed Circuit Board (FPCB) type, and the other of them is a tactile or tact switch type.

A switch of the FPCB type does not provide the user with excellent performance with respect to click feeling or tactile response. However, when adopting the switch of the FPCB type, it is necessary to perform a soldering process of soldering the switch of the FPCB to the PBA. Also, because an FPCB itself is relatively expensive, it is common for standard or ordinary devices to adopt the tact switch type. Some cutting edge devices however may adopt the use of the FPCB switch.

However, while in case of a tact switch, has the benefit of being relatively inexpensive, a side key assembly adopting this tact switch can have other problems. The use of a tact switch can cause a result in which there are problems such as a vibration noise and deterioration in click feeling due to the accumulation of various tolerances such as a tolerance of a Surface Mounted Device (SMD) of the PBA and an injection molding tolerance of a side key formed by an injection molding type.

In order to improve a vibration noise and click feeling of the side key assembly adopting the tact switch, injection molding processes and methods must be continuously adjusted. This results in the increase of research and development costs and nonetheless does not provide an ideal solution for an effect for improving the vibration noise and click feeling. In addition, when installing additional portions and components to improve click feeling, space utilization of the side key assembly may deteriorate.

SUMMARY

An exemplary aspect of the present invention is to solve at least some of the above-mentioned problems and/or disadvantages and to provide at least the advantages described below. Accordingly, an exemplary aspect of the present invention is to provide a key assembly for removing a vibration noise and improving click feeling and tactile response and an electronic device having the same.

Another exemplary aspect of the present invention is to provide a key assembly for simultaneously improving click feeling and tactile response of an electronic device, reducing its costs, and enhancing its space utilization and an electronic device having the same.

In accordance with an exemplary aspect of the present invention, an electronic device includes a key assembly disposed such that a part thereof is extending into and exposed within the interior of the electronic device; and a switch device disposed within the interior of the electronic device to perform an electric switching operation in response to a force exerted on the key assembly, wherein the key assembly includes a key body of resilient elastic materials and contact projections, each of the contact projections which is protruded and formed in a direction extending from the key body towards the switch device and wherein the key body is installed such that a contact surface of each of the contact projections is in contact with the switch device and wherein each of the contact projections is pushed back and elastically deformed by a certain predetermined distance by the switch device.

In accordance with another exemplary aspect of the present invention, a key assembly includes: a key body of elastic materials; and contact projections formed in the key body wherein each of the contact projections protrudes from the key body for pressing a switch device which is installed and spaced apart from the key body at a certain interval, wherein the key body is installed such that a contact surface of each of the contact projections is in contact with and is pushed back by a certain distance by a force exerted by the switch device.

In accordance with another exemplary aspect of the present invention, an electronic device includes: a key assembly disposed such that a part thereof is extending into and exposed within the interior of the electronic device; and a tact switch disposed in the electronic device in alignment with the key assembly to perform an electric switching operation in response to a force exerted on the key assembly, wherein the key assembly includes a key case installed to be exposed to the outside of the electronic device, a key body of elastic materials which is combined and fixed with the key case, wherein the key case is attached to an outer surface of the key body and adapted to receive and support the key body, the key case being comprised of contact projections, each of the contact projections, having an inner hollow cavity, wherein each of the contact projections is protruded and formed in a direction from the key body and extending toward the tact switch, a push projection which is formed within the hollow cavity and is formed to be protruded on a surface of the key body in a direction toward the switch device wherein the hollow cavity provides a predetermined gap between the push projection and an inner wall of the contact projections; and one or more concave groove portions formed surrounding each of the contact projections of the key body to provide enhanced elasticity of each of the contact projections and wherein the key body is installed such that a contact surface of each of the contact projections is in contact with and pushed back by a certain distance by a force exerted by a contact head of the tact switch.

BRIEF DESCRIPTION OF THE DRAWINGS

The above and other exemplary aspects, features and advantages of certain exemplary embodiments of the KEY ASSEMBLY AND ELECTRONIC DEVICE HAVING THE SAME according to the present invention will become more apparent to a person of ordinary skill in the art from the following detailed description taken in conjunction with the accompanying drawings, in which.

DETAILED DESCRIPTION

Exemplary embodiments of the present invention will now be described herein below with reference to the accompanying drawings. In the following description, well-known functions or constructions may not be described in detail when they would obscure appreciation of the present invention by a person of ordinary skill in the art with unnecessary detail of the well-known functions and structures. Also, the terms used herein are defined according to the functions of the present invention as would be understood by a person of ordinary skill in the art. Thus, the terms may vary depending on user's or operator's intension and usage. That is, the terms used herein must be understood based on the descriptions made herein in view of the ordinary level of skill in the art.

In describing various embodiments of the present invention, an electronic device may be at least one of various electronic devices, each of them which has a key assembly capable of performing a physical key button operation. The electronic device may be any one of a Personal Digital Assistant (PDA), a laptop computer, a mobile phone, a smart phone, a netbook, a Mobile Internet Device (MID), a Ultra Mobile PC (UMPC), a tablet PC, a navigation device, and an MP3 player.

Hereinafter, a description will be given with reference to, but is not limited to, a side key which is installed at a side of the electronic device. For example, the electronic device may adopt a physical key assembly, for performing various functions, which is disposed such that a part of the physical key assembly is exposed to the outside of the electronic device to adjust a tact switch installed in the electronic device.

Figure 1:
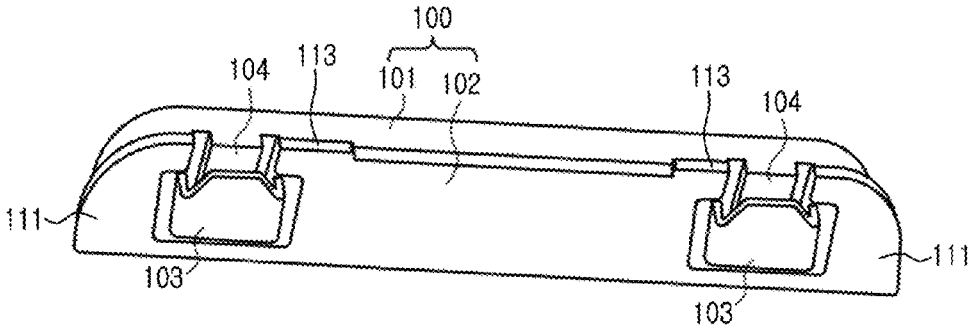
FIG. 1 illustrates an exemplary structure of a side key in a key assembly according to an embodiment of the present invention.
Figure 2:
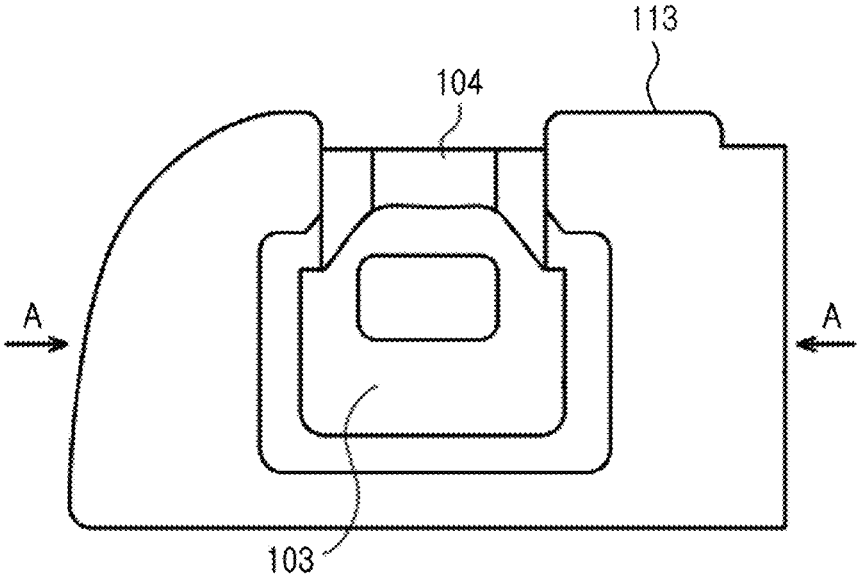
FIG. 2 illustrates an exemplary lower surface structure of a contact projection of FIG. 1 according to an embodiment of the present invention.
Figure 3:
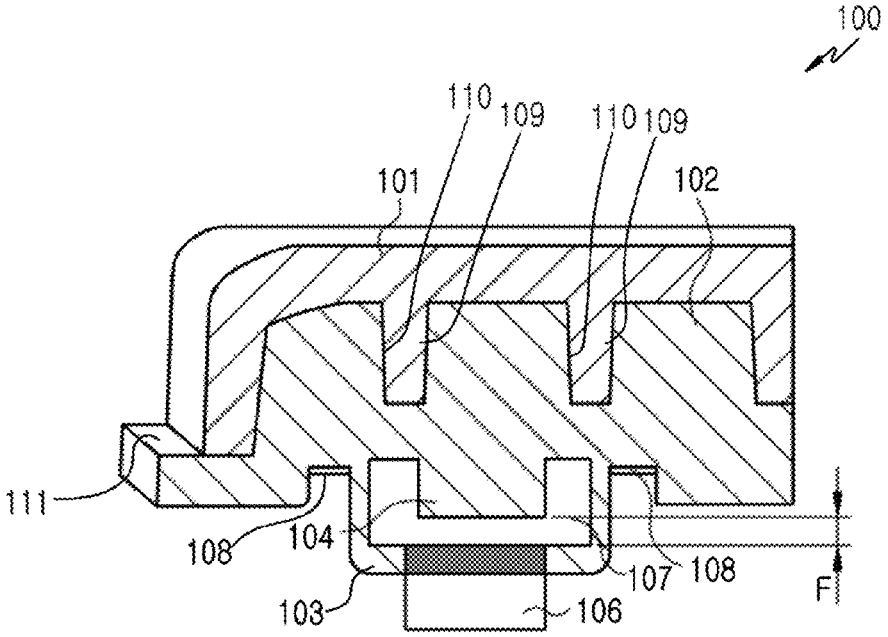
FIG. 3 illustrates an exemplary cross sectional view taken from a line A-A of FIG. 2 according to an embodiment of the present invention.
Figure 4:
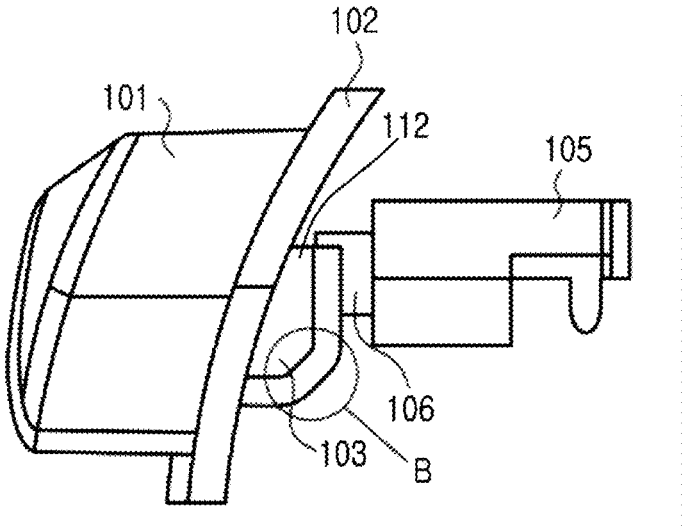
FIG. 4 illustrates an exemplary combination state structure of a key assembly according to an embodiment of the present invention.

FIG. 1 illustrates a structure of a side key in a key assembly according to one exemplary embodiment of the present invention. FIG. 2 illustrates a lower surface structure of a contact projection depicted in FIG. 1 according to one exemplary embodiment of the present invention. FIG. 3 illustrates a cross sectional view taken from a line A-A of FIG. 2 according to one exemplary embodiment of the present invention. FIG. 4 illustrates a combination state structure of a key assembly according to one embodiment of the present invention.

Referring to FIGS. 1 to 4, the side key denoted by 100 may include a key case 101 and a key body 102. The key case 101 is formed of plastic or resin through an injection molding type process. For example, the key body 102 may be formed of resin such as urethane and silicon or other elastic and resilient materials such as rubber. Therefore, materials of the key case 101 may be provided to be hard relatively as compared to key body 102. Materials of the key body 102 may be provided to be soft relatively. The key case 101 and the key body 102 may be coupled by, but is not limited to, an adhesive. Also, the key case 101 and the key body 102 may be coupled through alternate methods such as a well-known ultrasonic fusion method and a well-known insert molding method.

In order to enhance combining force between the key case 101 and the key body 102, a plurality of combining projections 109 may be formed on an inner surface of the key case 101. Complementary to the plurality of combining projections 109, a plurality of fixed concave groove parts 110 may be formed in an upper surface of the key body 102 for receiving the combining projections 109 in alignment with the combining projections 109. Accordingly, inserting the plurality of combining projections 109 of the key case 101 into the plurality of fixed concave groove parts of the key body 102 may help to enhance combining force between the key case 101 and the key body 102 by providing an increased area of contact between the key case 101 and the key body 102. In addition there is a provided a close interference fit between the combining projections and the combining groove parts. In accordance with one embodiment of the present invention, a fixing part 111 may be integrated with both sides of the key body 102 to mount and fix the side key 100 on a certain portion of an electronic device. In accordance with one embodiment of the present invention, several convex edges 113 may be formed on other portions except for both the sides in the key body 102 to fix and install the side key 100. In accordance with one embodiment of the present invention, contact projections 103 which are projected toward a lower side of the side key 100 in a direction to come in contact with a tact switch 105 (see FIG. 4) that is disposed in the electronic device in response to a lower side of the side key 100 may be formed on lower certain positions of the side key 100. The same elastic materials as the key body 102 may be adopted in each of the contact projections 103. In accordance with one embodiment of the present invention, the contact projections 103 may be integrated with the key body 102.

The tact switch 105 may be mounted on one side of a PBA of the electronic device. The tact switch 105 may be directly mounted on the PBA through a surface mount device (SMD) soldering process. Accordingly, a single soldering process may be omitted in comparison with a switch of an FPCB type. In accordance with one embodiment of the present invention, the tact switch 105 has at least one contact head 106. When the contact head 106 is pushed, the tact switch 105 is electrically connected to execute a corresponding function.

Referring to FIG. 4, a contact surface of each of the contact projections 103 is pushed to a certain distance by the contact head 106 of the tact switch 105. In accordance with one embodiment of the present invention, a vibration noise (pushing noise) generated by accumulation tolerance in the components such as injection molding tolerance of the side key 100 and mounting tolerance of the tact switch 105 may be improved and click feeling may be improved by pushing the contact projections 103 to the certain distance by the contact head 106 and thereby minimizing the effects of the accumulation tolerance.

A reference numeral B shown in FIG. 4 indicates a side structure of each of the contact projections 103. In accordance with one embodiment of the present invention, the side structure may save a space of the side key 100 by forming a "C"-type cross section.

Referring to FIGS. 1 and 2 again, a hollow cavity 107 (see FIG. 3) may be formed in each of the contact projections 103. In accordance with one exemplary embodiment of the present invention, the cavity 107 may be formed in each of the contact projections 103. Preferably, an opening 112 (see FIG. 4) may be formed in one side of each of the contact projections 103. The opening 112 provides greater flexibility of the contact projections 103, thus allowing for greater movement of the contact projections 103 in response to pressure provided by the contact head 106.

In accordance with one exemplary embodiment of the present invention, concave groove portions 108 are formed around a portion where each of the contact projections 103 of a lower surface of the side key 100 is formed to reinforce an elastic deformation effect of the contact projections 103 by allowing for greater flexing of the contact projections 103 around the base of the contact projections, thus allowing for greater movement of the contact projection in response to pressure provided by the contact head 106.

In accordance with one exemplary embodiment of the present invention, a push projection 104 may be projected and formed from a lower surface of the key body 102 on the cavity 107 of each of the contact projections 103. The push projection 104 may have a structure in which it is faced with pressure provided by the contact head 106 of the tact switch 105.

Referring to FIG. 3, a reference numeral F denotes a certain interval between the push projection 104 and an inner surface of the cavity 107 which is faced with the push projection 104, after the side key 100 is installed. In accordance with one embodiment of the present invention, the certain interval F may be 0.1 mm.

In accordance with one embodiment of the present invention, a push distance to which the contact head 106 pushes the contact surface of each of the contact projections 103 and a wall thickness of each of the contact projections 103 may be the same with each other. In other words, in one embodiment of the present invention, the interval F may be the same as the thickness of the wall of contact projections 103.

In accordance with one embodiment of the present invention, when the key body 102 is manufactured by utilizing urethane, a wall thickness of each of the contact projections 103 may be set to 0.3 mm. Herein, an interval between the push projection 104 and an outer surface of the cavity 107 which is faced with the push projection 104 may be set to 0.4 mm. Accordingly, after installation of the side key 100 is completed, the contact head 106 pushes the contact surface of each of the contact projections 103 upwardly. For this reason, a side wall of each of the contact projections 103 which are formed of elastic materials is pre-loaded by the force of the contact head 106 bearing against the contact surface of each of the contact projections and is thus elastically deformed. Herein, the concave groove portions 108 are formed around each of the contact projections 103 of the lower surface of the key body 102. Accordingly, elastic deformation efficiency of the side wall of each of the contact projections 103 may be more enhanced due to the groove portions 108 allowing greater movement of the side wall of each of the contact projections. Thus in this particular embodiment, the interval between the push projection 104 and the inner surface of the cavity 107 which is faced with the push projection 104 may be set at 0.1 mm.

In accordance with one embodiment of the present invention, click feeling and a vibration noise of the side key 100 may be improved by adjusting the certain interval between the push projection 104 and the inner surface of the cavity 107 which is faced with the push projection 104. In accordance with one embodiment of the present invention, although tolerance on the side key 100 or the tact switch 105 is generated, a vibration noise (pushing noise) may be clearly improved according to the above-described contact type between the contact head 106 and each of the contact projections 103. The interval may be as small as possible and also, the interval may be varied according to material of the key body 102.

In accordance with various embodiments of the present invention, the key assembly and the electronic device having the same may remove a vibration noise considerably, improve click feeling, reduce its costs, enhance its space utilization, and improve key movement by external force in a set state.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. An electronic device comprising:

a key assembly disposed such that a part thereof is extending into and disposed within the interior of the electronic device;

a switch device disposed within the interior of the electronic device to perform an electric switching operation in response to a force exerted on the key assembly, wherein the key assembly includes a key body of resilient elastic materials and contact projections, each of the contact projections which is protruded and formed in a direction extending from a lower surface of the key body towards the switch device and wherein the key body is installed such that a contact surface of each of the contact projections is in contact with the switch device and wherein each of the contact projections includes a lower surface that is pushed back toward the lower surface of the key body and elastically deformed by a certain predetermined distance by the switch device, the contact projections biasing the key assembly toward an unactuated position; and a hollow cavity formed within each of the contact projections, wherein the contact surface of each of the contact projections is elastically deformed by force from the switch device a predetermined distance, wherein the predetermined distance is equal to a wall thickness of each of the contact projections formed between the hollow cavity and the switch device.

2. The electronic device of claim 1, further comprising an opening provided in one side of each of the contact projections extending into the hollow cavity.

3. The electronic device of claim 2, further comprising a push projection protruded and formed within the hollow cavity, wherein the push projection is formed to be protruded on a surface of the key body in a direction toward the switch device wherein the hollow cavity provides a gap between the push projection and an inner wall of the contact projections.

4. The electronic device of claim 3, wherein the key assembly is installed such that the hollow cavity provides a separation distance of a certain interval between the push projection and the inner surface of the contact projections.

5. The electronic device of claim 1, further comprising one or more concave groove portions are formed in the key assembly surrounding each of the contact projections of the key body to provide increased elasticity of each of the contact projections.

6. The electronic device of claim 1, further comprising a key case attached to an outer surface of the key body and adapted to receive and support the key body wherein the key case in comprised of materials which are stronger than that of the key body.

7. The electronic device of claim 6, further comprising:

one or more combining projections protruded and formed on one of either the key case and the key body; and one or more fixed concave groove parts, in alignment with and adapted to receive the one or more combining projections, which are formed in the other of either the key case or the key body to provide enhanced combining force.

8. The electronic device of claim 1, wherein the key body is formed of one or more materials selected from a group consisting of urethane materials, silicon materials, and rubber materials.

9. The electronic device of claim 1, wherein the switch device is a tact switch including a contact head for pressing the contact surface of each of the contact projections.

10. A key assembly comprising:

a key body of elastic materials;

contact projections formed in the key body wherein each of the contact projections protrudes from a lower surface of the key body for pressing a switch device which is installed and spaced apart from the key body at a certain interval, wherein the key body is installed such that a contact surface of each of the contact projections is in contact with and includes a lower surface that is pushed back toward the lower surface of the key body by a certain distance by a force exerted by the switch device, the contact projections biasing the key assembly toward an unactuated position; and a hollow cavity, which is formed in each of the contact projections with an opening provided in one side of each of the contact projections extending into the hollow cavity, wherein the contact surface of each of the contact projections is elastically deformed by a force exerted by the switch device, which is equal to a wall thickness of each of the contact projections formed between the hollow cavity and the switch device.

11. The key assembly of claim 10, further comprising a push projection protruded and formed within the hollow cavity, wherein the push projection is formed to be protruded on a surface of the key body in a direction extending toward the switch device wherein the hollow cavity provides a gap between the push projection and an inner wall of the contact projections.

12. The key assembly of claim 11, wherein the key assembly is installed such that the hollow cavity provides a separation distance of a certain interval between the push projection and the inner surface of the contact projections.

13. The key assembly of claim 10, further comprising one or more concave groove portions formed in the key assembly surrounding each of the contact projections of the key body to provide increased elasticity of each of the contact projections.

14. The key assembly of claim 10, wherein the key body is formed of one or more materials selected from a group consisting of urethane materials, silicon materials, and rubber materials.

15. The key assembly of claim 10, wherein the switch device is a tact switch including a contact head for pressing the contact surface of each of the contact projections.

16. An electronic device comprising:

a key assembly disposed such that a part thereof is extending into and disposed within the interior of the electronic device; and a tact switch disposed in the electronic device in alignment with the key assembly to perform an electric switching operation in response to a force exerted on the key assembly, wherein the key assembly includes a key case installed to be exposed to the outside of the electronic device, a key body of elastic materials which is combined and fixed with the key case, wherein the key case is attached to an outer surface of the key body and adapted to receive and support the key body, the key case being comprised of contact projections, the contact projections biasing the key assembly toward an unactuated position, each of the contact projections, having an inner hollow cavity, wherein each of the contact projections is protruded and formed in a direction from the key body and extending toward the tact switch, a push projection which is formed within the hollow cavity and is formed to be protruded from a lower surface of the key body in a direction toward the switch device wherein the hollow cavity provides a predetermined gap between the push projection and an inner wall of the contact projections; and one or more concave groove portions formed surrounding each of the contact projections of the key body to provide enhanced elasticity of each of the contact projections and wherein the key body is installed such that a lower surface of a contact surface of each of the contact projections is in contact with and is pushed back toward the lower surface of the key body by a certain distance by a force exerted by a contact head of the tact switch.

* * * * *

UNITED STATES PATENT AND TRADEMARK OFFICE

CERTIFICATE OF CORRECTION

PATENT NO. : 9,257,240 B2
APPLICATION NO. : 13/927369
DATED : February 9, 2016
INVENTOR(S) : Jeong-Seok Park et al.

It is certified that error appears in the above-identified patent and that said Letters Patent is hereby corrected as shown below:

On the Title Page

Item 30, Line 1 should read as follows:
--...Jun. 26, 2012 (CN) 201220303763.X...--

In the Claims

Column 6, Claim 6, Line 66 should read as follows:
--...case is comprised of...--

Signed and Sealed this
Tenth Day of May, 2016

Michelle K. Lee

Michelle K. Lee
*Director of the United States Patent and Trademark Office*